US008813664B2

(12) United States Patent
Sekine

(10) Patent No.: US 8,813,664 B2
(45) Date of Patent: Aug. 26, 2014

(54) CONTROLLER, COMPUTER READABLE MEDIUM STORING CONTROL PROGRAM, AND SEWING MACHINE

(75) Inventor: Kiyokazu Sekine, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 945 days.

(21) Appl. No.: 12/953,934

(22) Filed: Nov. 24, 2010

(65) Prior Publication Data

US 2011/0120359 A1 May 26, 2011

(30) Foreign Application Priority Data

Nov. 25, 2009 (JP) ..... 2009-267460

(51) Int. Cl.

| | |
|---|---|
| ***D05B 21/00*** | (2006.01) |
| ***D05B 19/10*** | (2006.01) |
| ***D05C 5/04*** | (2006.01) |
| ***D05B 25/00*** | (2006.01) |

(52) U.S. Cl.

CPC *D05C 5/04* (2013.01); *D05B 19/10* (2013.01); *D05B 25/00* (2013.01)

USPC ..... 112/102.5

(58) Field of Classification Search

USPC ..... 112/102.5, 103, 470.01, 470.04, 112/470.06, 163, 475.18, 475.19, 220

See application file for complete search history.

(56) References Cited

U.S. PATENT DOCUMENTS

| | | | | |
|---|---|---|---|---|
| 4,635,574 | A * | 1/1987 | Fujita et al. | 112/470.04 |
| 4,932,342 | A * | 6/1990 | Hisatake et al. | 112/103 |
| 5,253,599 | A * | 10/1993 | Hashiride | 112/102.5 |
| 5,313,896 | A | 5/1994 | Hashiride | |
| 5,978,559 | A | 11/1999 | Quinion | |
| 6,698,396 | B2 * | 3/2004 | Pfaeffle et al. | 123/299 |
| 6,925,946 | B1 * | 8/2005 | Kang | 112/102.5 |

FOREIGN PATENT DOCUMENTS

| | | | |
|---|---|---|---|
| GB | 2254450 | * 10/1992 | D05B 21/00 |
| JP | A-5-76670 | 3/1993 | |
| JP | A-10-266058 | 10/1998 | |
| JP | A-11-175300 | 7/1999 | |
| JP | A-2004-94407 | 3/2004 | |

* cited by examiner

*Primary Examiner* — Tejash Patel

(74) *Attorney, Agent, or Firm* — Oliff PLC

(57) ABSTRACT

A controller is disclosed that is communicably connected to a plurality of sewing machines and that includes a display device displaying at least information pertaining to a sewing operation. The controller includes a display controller provided with a queue allocated to each of the plurality of sewing machines and displaying sew pattern data stored in each of the queues to the display device such that the sew pattern data is organized by the sewing machine associated therewith; a specifier specifying one or more sew pattern data from a source queue associated with one of the sewing machines displayed on the display device; a data modifier transferring or copying the one or more sew pattern data specified by the specifier to the destination queue associated with another sewing machine and a data transmitter transmitting the sew pattern data stored in the modified queues to the sewing machines associated therewith.

11 Claims, 15 Drawing Sheets

CONTROLLER, COMPUTER READABLE MEDIUM STORING CONTROL PROGRAM, AND SEWING MACHINE

CROSS-REFERENCE TO RELATED APPLICATION

This application is based upon and claims the benefit of priority from the prior Japanese Patent Application 2009-267460, filed on, Nov. 25, 2009, the entire contents of which are incorporated herein by reference.

FIELD

The present disclosure relates to a controller that is communicably connected to a plurality of sewing machines; a computer readable medium storing a control program for execution by the controller; and a sewing machine communicably connected to at least one other sewing machine.

BACKGROUND

A system configured by a host controller and multiple client sewing machines have been known in which embroidery pattern data is distributed to the client sewing machines from the controller. One example of such system is configured by a single computer node that provides embroidery pattern data to the multiple sewing machines communicably connected to it to allow each of the sewing machines to sew a pattern based on the given embroidery pattern.

In such system, multiple patterns sewn by the sewing machines are presented on the display of the computer. Thus, the user is allowed to view the patterns sewn by the multiple sewing machines simultaneously through a single computer.

When sewing with multiple sewing machines, resource management capability such as a task rearrangement feature is useful in improving the system throughput. In this example, the embroidery data allocated to a given sewing machine can be transferred or copied to another sewing machine depending upon the progress of sewing at each of the sewing machines to streamline the throughput. However, currently available technology only allows monitoring of the embroidery data allocated to each of the sewing machines and does not allow rearrangement/reallocation of the embroidery data and thus, needs to be renovated.

SUMMARY

One object of the present disclosure is to provide a controller that is capable of simultaneously displaying sewing pattern data allocated to each of the multiple sewing machines and further allowing reallocation of the displayed sewing pattern data by transferring or copying it to another sewing machine. Another object of the present disclosure is to provide a computer readable medium storing a control program for execution by the controller, and a sewing machine provided with the aforementioned features of the controller.

In one aspect of the present disclosure, a controller is disclosed that is communicably connected to a plurality of sewing machines and that includes a display device displaying at least information pertaining to a sewing operation. The controller includes a display controller that is provided with a queue allocated to each of the plurality of sewing machines and that displays sew pattern data stored in each of the queues to the display device such that the sew pattern data is organized by the sewing machine associated therewith; a specifier that specifies one or more sew pattern data from a source queue associated with one of the sewing machines displayed on the display device; a data modifier that transfers or copies the one or more sew pattern data specified by the specifier from the Source queue to a destination queue associated with another sewing machine; and a data transmitter that transmits the sew pattern data modified by the data modifier stored in the source queue and the destination queue to the sewing machines associated therewith.

In another aspect of the present disclosure, a computer readable medium storing a control program is disclosed for execution by a controller that is communicably connected to a plurality of sewing machines and that includes a display device displaying at least, information pertaining to a sewing operation. The control program stored in the computer readable medium includes instructions for allocating a queue to each of the plurality of sewing machines and displaying sew pattern data stored in each of the queues to the display device such that the sew pattern data is organized by the sewing machine associated therewith; instructions for specifying one or more sew pattern data from a source queue associated with one of the sewing machines displayed on the display device; instructions for modifying to transfer or copy the one or more sew pattern data specified by the specifier from the source queue to a destination queue associated with another sewing machine; and instructions for transmitting the modified sew pattern data stored in the source queue and the destination queue to the sewing machines associated therewith.

Still in another aspect of the present disclosure, a sewing machine is disclosed that is communicably connected to at least one other sewing machine and that includes a display device displaying at least information pertaining to a sewing operation. The sewing machine includes a display controller that is provided with a queue allocated to each of the interconnected sewing machines and that displays sew pattern data stored in each of the queues to the display device such that the sew pattern data is organized by the sewing machine associated therewith; a specifier that specifies one or more sew pattern data from a source queue associated with one of the interconnected sewing machines displayed on the display device; a data modifier that transfers or copies the one or more sew pattern data specified by the specifier from the source queue to a destination queue associated with another interconnected sewing machine; and a data transmitter that transmits the sew pattern data modified by the data modifier stored in the source queue and the destination queue to the sewing machines associated therewith.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
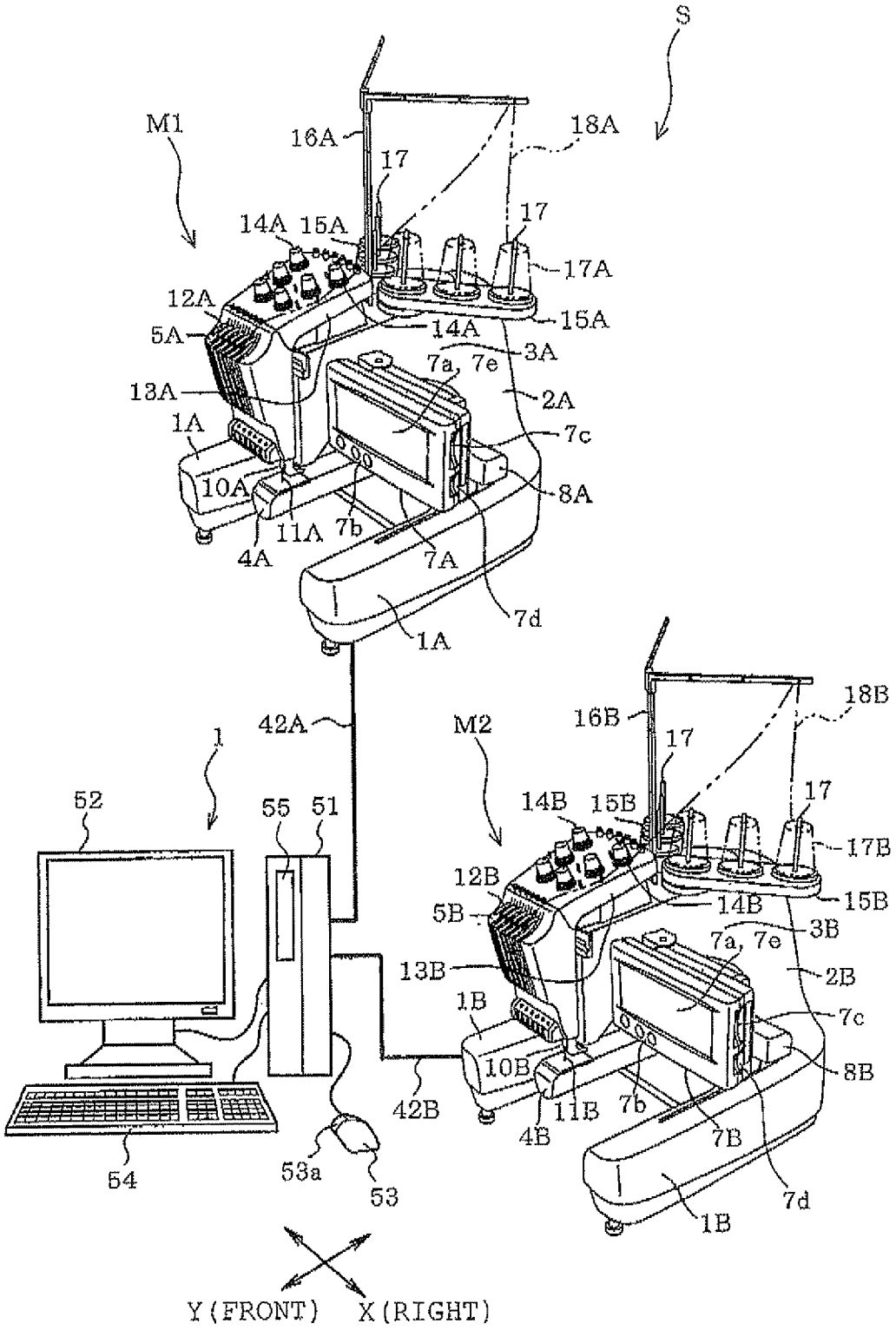
FIG. 1 shows one exemplary configuration of a embroidery processing system according to a first exemplary embodiment of the present disclosure including a plurality of sewing machines and a controller communicably connected to the plurality of sewing machines.

A first exemplary embodiment of the present disclosure is described with reference to FIGS. 1 to 10. As can be seen in FIG. 1, embroidery processing system S is configured by multiple multi-needle embroidery sewing machines M and controller 1. In the present exemplary embodiment, the system includes a couple of multi-needle embroidery sewing machines identified as multi-needle sewing machine M1 and M2.

Multi-needle sewing machines M1 and M2 are basically identical in structure and thus, will be described at once in the singular context. The reference symbols for elements of multi-needle sewing machine M1 will be suffixed by "A", whereas the reference symbols of elements of Multi-needle sewing machine 142 will be suffixed by "B".

Multi-needle sewing machine M is primarily configured by a pair of left and right feet 1A, 1B that support the multi-needle sewing machine M in its entirety, pillar 2A, 2B standing at the rear end of feet 1A, 1B, arm 3A, 3B extending forward from the upper portion of pillar 2A, 2B, cylinder bed 4A, 4B extending forward from the lower end of pillar 2A, 2B, and needle-bar case 5A, 5B attached to the front end of arm 3A, 3B. Multi-needle sewing machine M1, M2 is further provided with components such as a controller unit 6A, 6B shown in FIGS. 2A and 2B that are responsible for the overall control of multi-needle sewing machine M1, M2 and control panel 7A, 7B.

Figure 2A:
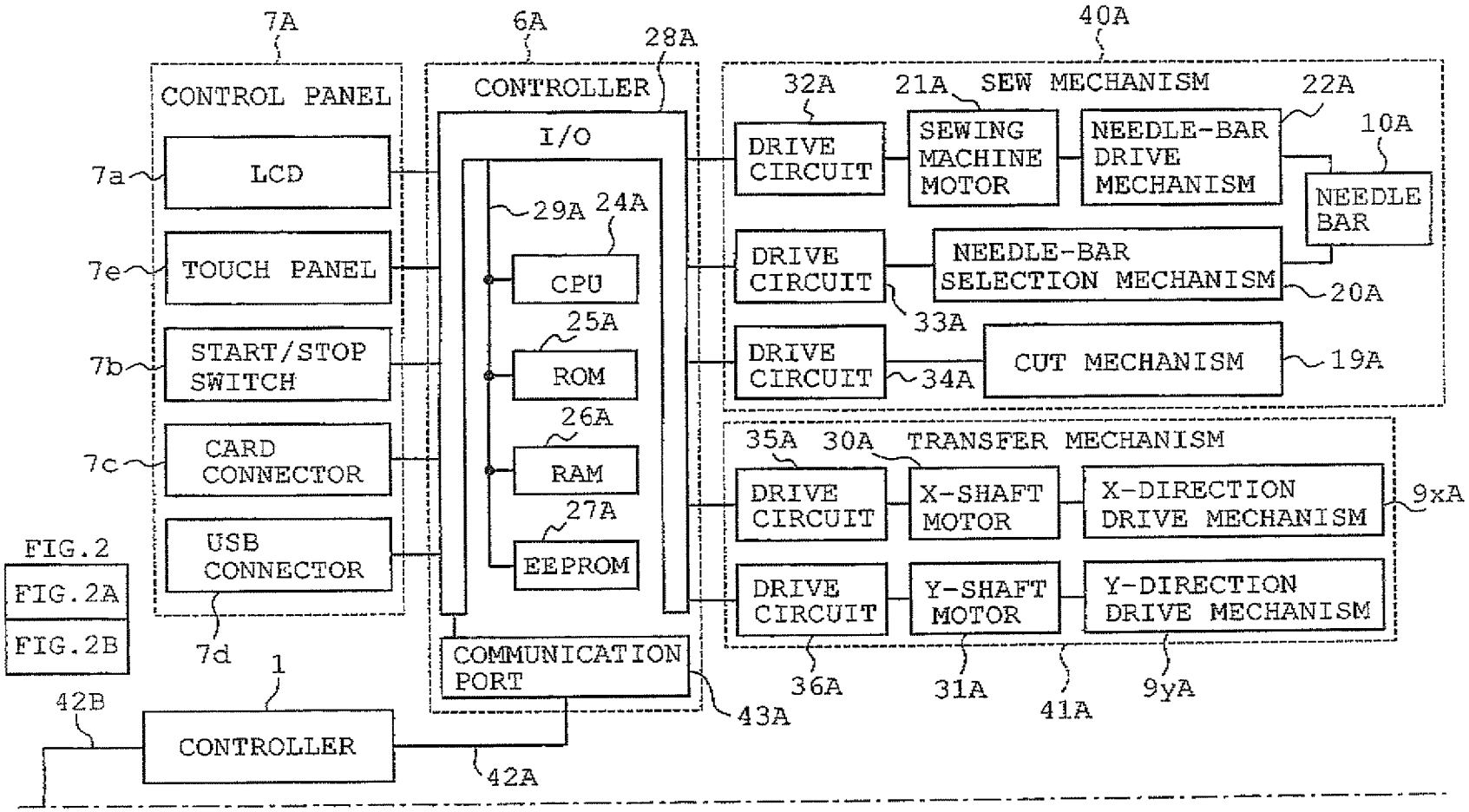
FIGS. 2A and 2B taken together show a block diagram indicating an electrical configuration of the system.
Figure 2B:
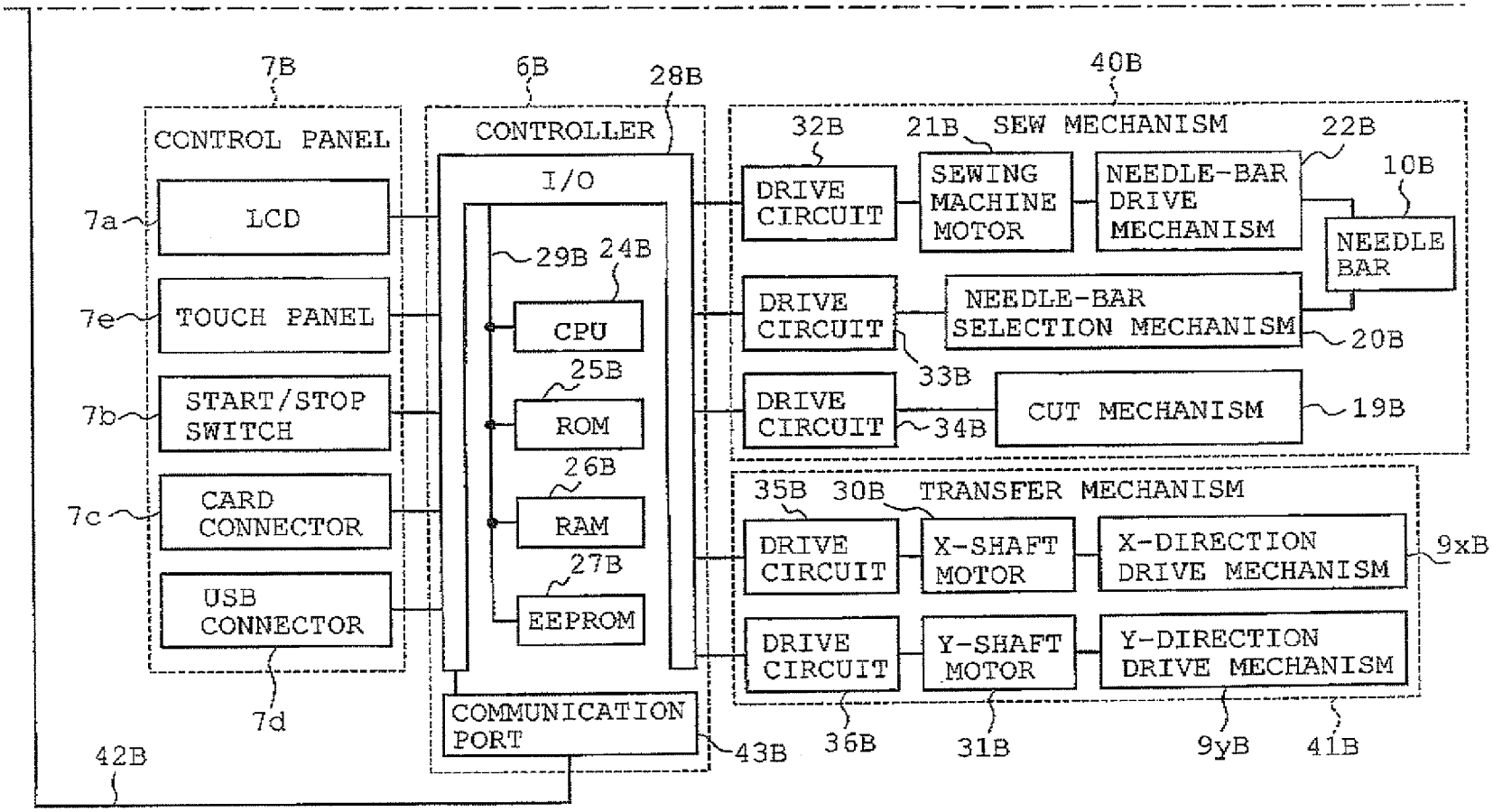

Above feet 1A, 1B, carriage 8A, 8B oriented in the left and right direction is disposed which contains X-drive mechanism 9*x*A, 9*x*B shown in FIGS. 2A and 2B that drives a frame mount base not shown provided in front of carriage 8A, 8B in the X direction or the left and right direction. Within the left and right feet 1A, 1B, Y-direction drive mechanism 9*y*A, 9*y*B shown in FIGS. 2A and 2B is provided that drives carriage 8A, 8B in the Y direction or the front and rear direction. The workpiece cloth not shown to be embroidered is held, for instance, by a rectangular embroidery frame not shown which is mounted on the frame mount base. The embroidery frame is driven by drive motor of X-direction drive mechanism 9*x*A, 9*x*B, represented as X-shaft motor 30A, 30B in FIGS. 2A and 2B, so as to be driven in the X-direction along with the frame mount base. Similarly, the embroidery frame is driven by the drive motor of 1-direction drive mechanism 9*y*A, 9*y*B, represented as 1-shaft motor 31A, 31B in FIGS. 2A and 2B, so as to be driven in the Y-direction in synchronism with carriage 8A, 8B. Thus, the workpiece cloth not shown held by the embroidery frame also not shown is fed in the desired directions.

Needle-bar case 5A, 5B supports six needle bars 10A, 1013, though only one is shown in FIG. 1, extending up and down that are arranged side by side in the left and right direction. Needle bars 10A, 10B are allowed to move up and down and each needle bar 10 has sewing needle 11A, 11B attached on its lower end. Needle-bar case 5A, 5B is further provided with six thread take-ups 12A, 12B that are associated with the six needle bars 10A, 10B. Thread take-ups 12A, 12B are also allowed to move up and down.

Needle-bar case 5A, 5B has a forwardly declining thread tension regulator base 13A, 13B secured on its upper side. Thread tension regulator base 13A, 13B is provided with six thread tension regulators 14A, 14B for making adjustments in thread tension. Behind thread tension base 13A, 13B, a pair of left and right thread spool base 15A, 15B and thread guide mechanism 16A, 16B for preventing tangling are provided. Though not shown in detail, both thread spool base 15A, 15B and thread guide mechanism 16A, 16B are spread out in a V-formation opening up toward the rear side as shown in FIG. 1 when in use, and closed in an I-formation not shown parallel to the front and rear direction of when not in use. Thread spool base 15A, 15B are each provided with 3 thread spool pins 17 each of which fits into thread spool 17A, 17B. Thus a total of six thread spools 17A, 17B equivalent in number to the number of sewing needles 11 can be mounted on the pair of the left and right thread spool bases 15A, 15B. Needle thread 18A, 18B extending from each thread spool 17A, 17B mounted on thread spool base 15A, 15B is fed to an eye not shown of each sewing needle 11A, 11B by way of components such as thread guide mechanism 16A, 16B, thread tension regulator 14A, 14B, and thread take-up mechanism. At the front end of cylinder bed 4A, 4B, out mechanism 19A, 19B shown in FIGS. 2A and 2B is provided for cutting needle thread 18A, 18B and bobbin thread not shown.

Arm 3A, 3B contains needle-bar selection mechanism 20A, 20B shown in FIGS. 2A and 2B that transfers needle-bar case 5A, 5B in the X-direction for thread replacement. Needle-bar selection mechanism 20A, 20B selectively transfers only one out of six associated pairs of needle bar 10A, 10B and thread take-up 12A, 12B to a drive position. Needle bar 10A, 10B and thread take-up 12A, 12B are driven up and down in synchronism at the drive position by sewing machine motor 21A, 21B shown in FIGS. 2A and 2B provided within pillar 2A, 2B. Multi-needle sewing machine M1, M2 forms embroidery stitches on the workpiece cloth held by the embroidery frame by the co-operation of needle bar 10A, 10B, thread take-up 12A, 12B and rotary shuttle not shown provided at the front end of cylinder bed 4A, 4B.

On the right side surface of arm 3A, 3B, a laterally elongate control panel 7A, 7B is provided which can be folded away in the retracted position when not in use. At the lower front surface of control panel 7A, 7B, switches such as start/stop switch 7*b* is provided for user operation. On the side surface of control panel 7A, 7B, interfaces such as card connector 7*c* for insertion of a memory card not shown and USE (Universal Serial Bus) connector 7*d* for detachable attachment of USB memory not shown are provided for taking in external data.

LCD 7*a* displays various information such as images of embroidery patterns, thread information of needle thread 18A, 18B set to each needle bar 10A, 10B, and selection of functionalities to be executed in a sewing operation, and various other information pertaining to the sewing operation. The front face of LCD 7*a* is at least in part configured as touch panel 7*e* implemented by touch keys made of transparent electrodes. The touch keys axe operated by the user to instruct execution of various functionalities, making numerical settings of various sew parameters, and specifying the change in thread color.

Referring now to the block diagram of FIGS. 2A and 2B, a description will be given on the control system of multi-needle sewing machine M1, M2. Control unit 6A, 6B is primarily configured by a microcomputer and contains components such as CPU 24A, 24B, ROM 25A, 25B, RAM 26A, 26E, EEPROM 27A, 278, input/output interface 28A, 28B (I/O), and bus 29A, 29B interconnecting the foregoing components. Control unit 6A, 6B is further provided with communication port 43A, 43B for establishing communication with controller 1 by way of communication cable 42A, 42B.

Input/output interface 28A, 28B establishes connections with drive circuits 32A(B) to 36A(B) that drive sewing machine motor 21A, 21B, needle-bar selection mechanism 20A, 20B, out mechanism 19A, 19B, X-shaft motor 30A, 30B, Y-shaft motor 31A, 31B as can be seen in FIGS. 2A and 2B. Input/output interface 28A, 28B is further connected to control panel 7A, 78, LCD 7*a*, start/stop switch 7*b*, card connector 7*c*, USB connector 7*d*, and touch panel 7*e*.

Components such as needle bars 10A, 10B, sewing needles 11A, 11B, rotary shuttle, sewing machine motor 21A, 21B, needle-bar drive mechanism 22A, 22B, needle-bar selection mechanism 20A, 20B, cut mechanism 19A, 19B, drive circuits 32A(B) to 34A(B) constitute sew mechanism 40A, 40B. Components for transferring the embroidery frame holding the workpiece cloth such as Y-direction drive mechanism 9*y*A, 9*y*8, X-direction drive mechanism 9*x*A, 9*x*B, X-shaft motor 30A, 30B, Y-shaft motor 31A, 31B, drive circuit 35A, 35B, and drive circuit 36A, 36B constitute the transfer mechanism 41A, 41B. Control unit 6A, 6B controls the drive of each of the above described actuators according to a sewing control program and embroidery pattern data or more generally sewing pattern data transmitted from controller 1 as later described. Control unit 6A, 6B executes a series of sewing operation on the workpiece cloth through co-operation of sew mechanism 40A, 40B, and transfer mechanism 41A, 41B.

ROM 25A, 25B stores computer programs such as sew control program, master thread information table, thread specification control program, and display control program. Master thread information table contains any and all information pertaining to different types of thread used in embroidery and contains at least thread color data. Thread specification control program allows the user to associate the thread color data indicating the color of needle thread 18A, 18B fed from thread spool 17A, 17B with needle bar 10A, 10B. Display control program controls LCD 7*a* provided on control panel 7A, 7B.

Controller 1 is configured, for instance, as an off-the-shelf personal computer, which is independent of multi-needle sewing machines M1 and M2. Controller 1 is configured by main body 51 of the personal computer, display 52, mouse 53, and keyboard 54. Display 52 may come in the form of a color CRT (Cathode Ray Tube) display and is at least responsible for displaying information pertaining to sewing such as displaying embroidery pattern data. Mouse 53 is a known user operated pointing device and is provided with buttons 53*a* to be operated by the user.

Main body 51, though not shown in detail, contains components such as CPU, ROM, RAM, input/output interface, internal storage device, and optical disc drive 55. Internal storage device may be configured by a hard disc drive. Optical disc drive 55 reads information from and writes information to storage medium, more specifically, optical discs such as CD (Compact Disc) and DVD (Digital Versatile Disc).

Main body 51 is further provided with communication port not shown for establishing communication with multi-needle sewing machine M1, M2 by way of communication cable 42A, 42B. Controller 1, when finding a connection established with multi-needle sewing machine M1, M2 by way of the communication port, creates folder FM1, FM2 corresponding to multi-needle sewing machine M1, M2.

Figure 3:
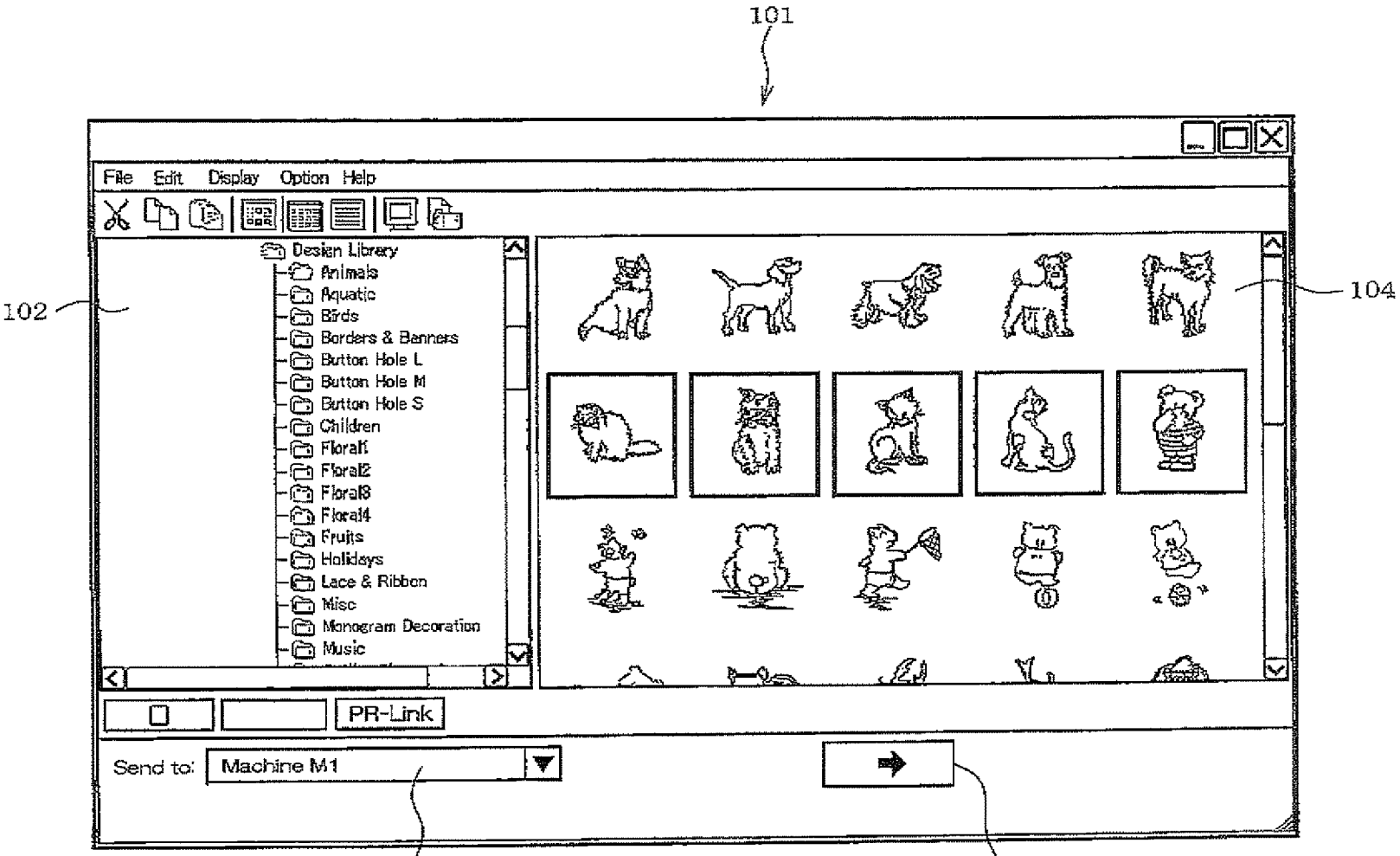
FIG. 3 exemplifies data selection/input screen.
Figure 4:
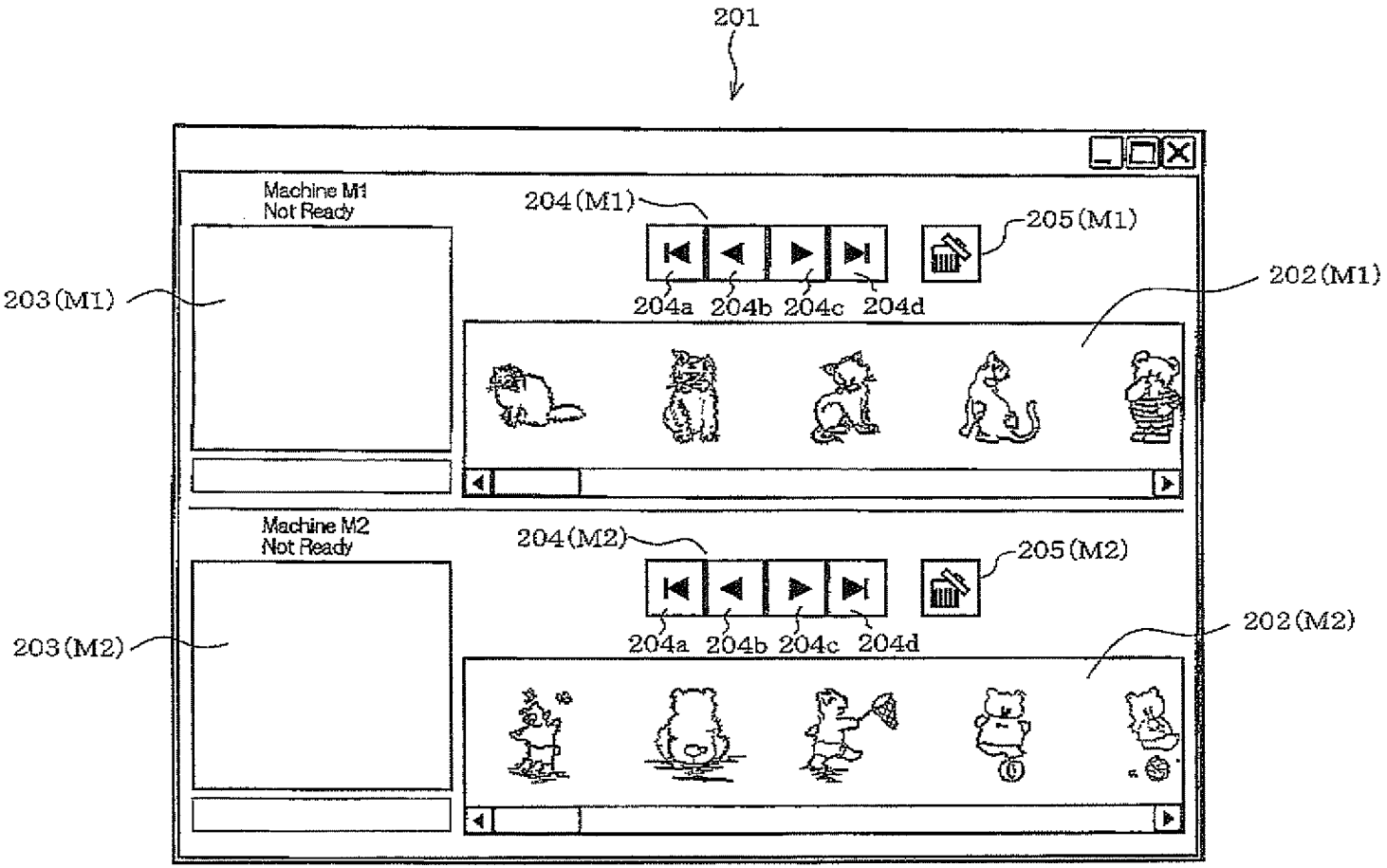
FIG. 4 exemplifies data transfer screen.

Controller 1 further stores various software or control programs such as data management software for embroidery pattern data management, data transfer software for transferring embroidery pattern data to multi-needle sewing machine M1, M2, data generation software for generating embroidery pattern data, and communication software for communicating with multi-needle sewing machine M1, M2. Referring now to FIGS. 3 and 4, a description will be given on data management software and data transfer software.

The data management software will be discussed in detail hereinafter with reference to FIG. 3.

Data management software outputs data selection/input screen 101 as exemplified in FIG. 3. Data selection/input screen 101 contains features such as folder display section 102, combo box 103, embroidery pattern data display section 104, and input buttons 105.

Controller 1 manages multiplicity of folders storing embroidery pattern data in a tree directory. Controller 1 displays the tree directory on folder display section 102. The user is allowed to select a given folder from the folders displayed on folder display section 102.

Combo box 103 is a control for selecting the sewing machine to which the embroidery pattern data is to be inputted from the choice of multi-needle sewing machine M1, M2 communicably connected to controller 1. In the present exemplary embodiment, combo box 103 provides a drop-down list, for instance, that provides choice between multi-needle sewing machine M1 and M2 to allow the user to select either one by mouse operation.

Embroidery pattern data display section 104, displays the embroidery pattern data stored in the folder selected in folder display section 102. The user is allowed to select one or more embroidery pattern data from the collection of embroidery pattern data displayed on embroidery pattern display section 104. Controller 1 creates a sequence file in a text file format within folder F (M1, M2) associated with multi-needle sewing machine M1, M2 selected from combo box 103. Controller 1 creates a list of embroidery pattern data in the ascending order of selected order into the sequence file such that each row represents a given embroidery pattern data.

Input button 105, when depressed, inputs the one or more embroidery pattern data selected at embroidery pattern data display section 104 and the sequence file that lists the selected order of each embroidery pattern data into folder F (M1, M2) which is associated with multi-needle sewing machine M1, M2 selected at combo box 103.

Referring now to FIG. 4, a description will be given on data transfer software.

Data transfer software outputs data transfer screen 201 as exemplified in FIG. 4. Data transfer screen 201 contains features such as queue display section 202 (M1, M2), post-transfer data display section 203 (M1, M2), rearrange button 204 (M1, M2), and delete button 205 (M1, M2) for each multi-needle sewing machine M1, M2 communicably connected to controller 1.

A series of embroidery pattern data inputted into folder F (M1, M2) according to the sequence listed in the sequence file contained in folder F (M1, M2) is displayed on queue display section 202 (M1, M2) in the form of a queue. Queue display section 202 (M1) displays queue Q (M1) associated with multi-needle sewing machine M1, and likewise, queue display section 202 (M2) displays queue Q (M2) associated with multi-needle sewing machine M2. As described above, controller 1 manages multiplicity of queues allocated to multiplicity of multi-needle sewing machines, in this example, queues Q (M1, M2) allocated to multi-needle sewing machines M1, M2 and displays one or more embroidery pattern data stored in queue Q (M1, M2) on display 52 for each multi-needle sewing machine M1, M2. In the example given in FIG. 4, queue Q (M1, M2) starts from the left side and ends at the right side.

When multi-needle sewing machine M1, M2 communicably connected controller 1 is started through operation of start/stop switch 7*b* (M1, M2), controller 1 sequentially transmits the embroidery pattern data stored in queue Q (M1, M2) associated with the started multi-needle sewing machine M1, M2 to the relevant multi-needle sewing machine M1, M2. Post-transfer data display section 203 (M1, M2) displays the embroidery pattern data having been transferred to multi-needle embroidery pattern data M1, M2, that is, the embroidery pattern data to be sewn by multi-needle sewing machine M1, M2.

Rearrange button 204 (M1, M2) rearranges the sequence of the embroidery pattern data within a given queue. Rearrange button 204 (M1, M2) is a group of buttons, namely, button 204*a*, button 204*b*, button 204*c*, and button 204*d*. Button 204*a* moves the embroidery pattern data selected by the user at queue display section 202 (M1, M2) to the front of the queue. Button 204*b* moves the selected embroidery pattern data one place forward within the queue. Button 204*c* moves the selected embroidery pattern data one place backward within the queue. Button 204*d* moves the selected embroidery pattern data to the end of queue Q (M1, M2).

Delete button 205 (M1, M2) deletes embroidery pattern data selected by the user at queue display section 202 (M1, M2) from queue Q (M1, M2).

Figure 5:
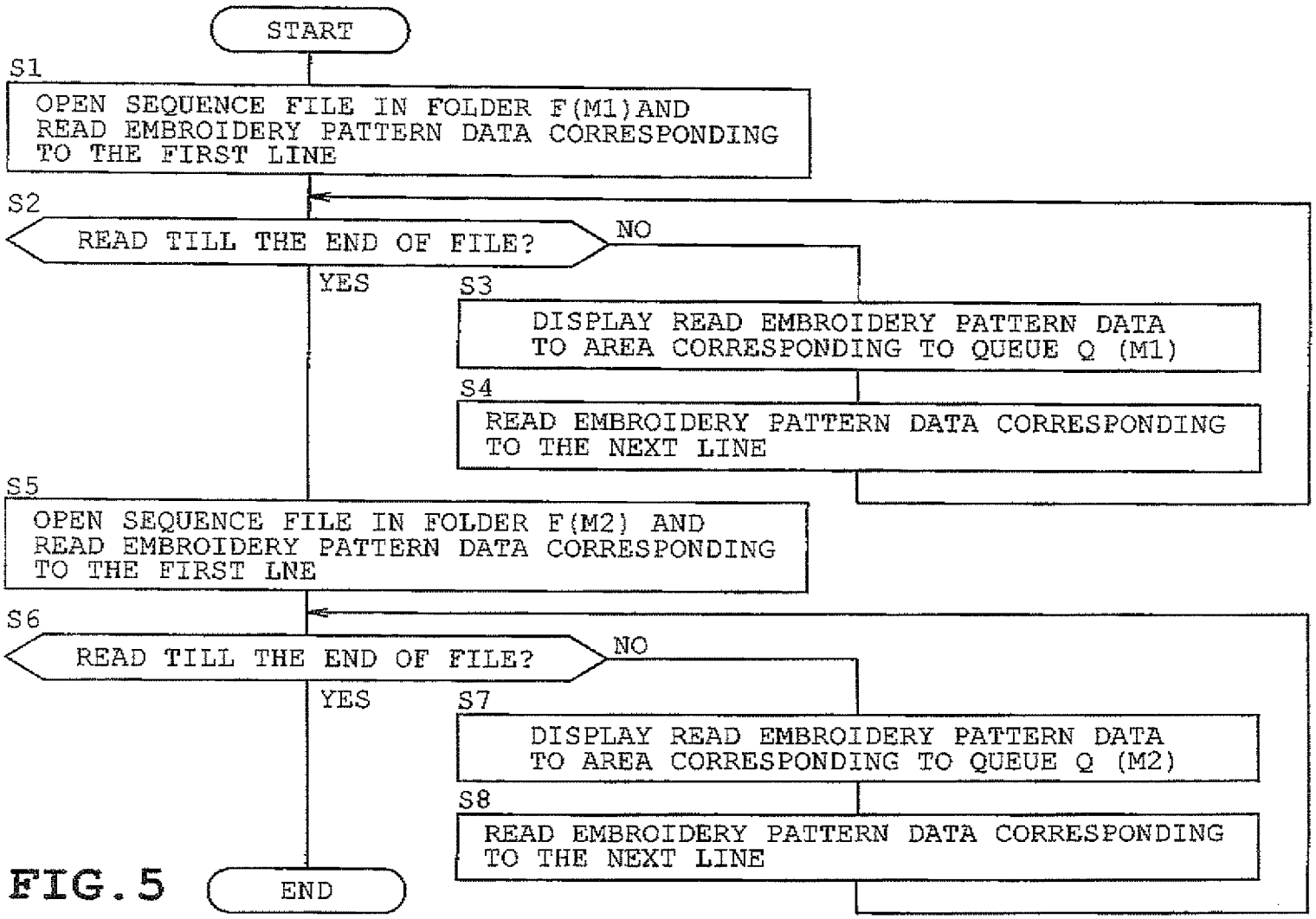
FIG. 5 is a flowchart indicating a process flow of a, display process for displaying queues.

The flow of control executed by controller 1 in displaying queue Q (M1, M2) on queue display section 202 (M1, M2) will be described with reference to the flowchart shown in FIG. 5.

Controller 1 begins the control with opening of the sequence file stored in folder F (M1) associated with multi-needle sewing machine M1 and reading the embroidery pattern data listed at the first row of the sequence file (step S1). Then, controller 1 determines whether or not the data within folder F (M1) has been read completely to the very last data, stated differently, whether or not any embroidery pattern data exists within folder F (M1) that has not been displayed yet (step S2). If not completely read (step S2; NO), controller 1 proceeds to step S3 and displays the read embroidery pattern data to the display area assigned to queue Q (M1), that is, queue display section 202 (M1) within data transfer screen 201. Then, controller 1 proceeds to the next row of the sequence file and reads the embroidery pattern data identified in the row (step S4). Controller 1 then returns the process flow back to step S2 and repeats step S2 to S4.

That is, at step S2, controller 1, when determining that the data within folder F (M1) has not been read to the very last data, displays the read embroidery pattern data (step S3) and proceeds to the next row (step S4). The above described sequence of processes displays the embroidery pattern data stored in folder F(M1) to queue display section 202 (M1) in the row-by-row sequence listed in the sequence file.

When controller 1 determines at step S2 that data within folder F (M1) has been read to the very last data (step S2: yes), proceeds to display queue Q (M2) associated with multi-needle sewing machine M2.

That is, controller 1 opens the sequence file stored in folder F (M2) associated with multi-needle sewing machine M2 and reads the embroidery pattern data listed at the first row of the sequence file (step S5). Then, controller 1 determines whether or not the data within folder F (M2) has been read completely to the very last data, stated differently, whether or not any embroidery pattern data exists within folder F (M2) that has not been displayed yet (step S6). If not completely read (step S6; NO), controller 1 proceeds to step S7 and displays the read embroidery pattern data to the display area assigned to queue Q (M2), that is, queue display section 202 (M2) within data transfer screen 201. Then, controller 1 proceeds to the next row of the sequence file and reads the embroidery pattern data identified in the row (step S8). Controller 1 then returns the process flow back to step S6 and repeats step S6 to S8.

That is, at step S6, controller 1, when determining that the data within folder F (M2) has not been read to the very last data, displays the read embroidery pattern data (step S7) and proceeds to the next row (step S8). The above described sequence of processes displays the embroidery pattern data stored in folder F (M2) to queue display section 202 (M2) in the row-by-row sequence listed in the sequence file. When controller 1 determines at step S6 that data within folder F (M2) has been read to the very last data (step S6: Yes), terminates the control. Controller 1 associates folder F (M1, M2) corresponding to queue Q (M1, M2) with the Y-directional (longitudinal) location of queue display section 202 (M1, M2) within the screen. Controller 1 further associates the embroidery pattern data stored in folder F (M1, M2) with the X-directional (lateral) location of each embroidery pattern data within the screen.

In operation, controller 1 configured as described above allows the user to select a given folder from the folders displayed on folder display 102 by mouse 53 operation in data selection/input screen 101 of the data management software. In response to the user's selection of a folder on folder display section 102, the embroidery pattern data contained in the selected folder are displayed on embroidery pattern data display 104 and the user is allowed to select one or more embroidery pattern data by mouse 53 operation. Then, the user is to select a given multi-needle sewing machine M1, M2 from combo box 103 by mouse operation 53 and press input button 105 to add the selected embroidery pattern data into queue Q (M1, M2) associated with the selected multi-needle sewing machine M1, M2. The embroidery pattern data added to queue Q (M1, M2) is populated in queue display section 202 (M1, M2) of data transfer screen 201 of the data transfer software. Similarly, the embroidery pattern data having been transferred to multi-needle sewing machine M1, M2 to be sewn is populated to post-transfer data display section 203 (M1, M2). The user is updated with the latest status through the relevant display sections of the screens as described above.

Controller 1 according to the first described exemplary embodiment allows modification, in other words, rearrangement of the specified embroidery pattern data. This rearrangement process can be broken down into steps (a) and (b) as described below.

(a): Specify one or more embroidery pattern data from one of queues Q (M1, M2) associated with multi-needle sewing machines M1, M2 by drag and drop operation of mouse 53.

(b): The specified one or more embroidery pattern data is transferred to other queue (M1, M2) associated with multi-needle sewing machine (M1, M2).

Figure 6:
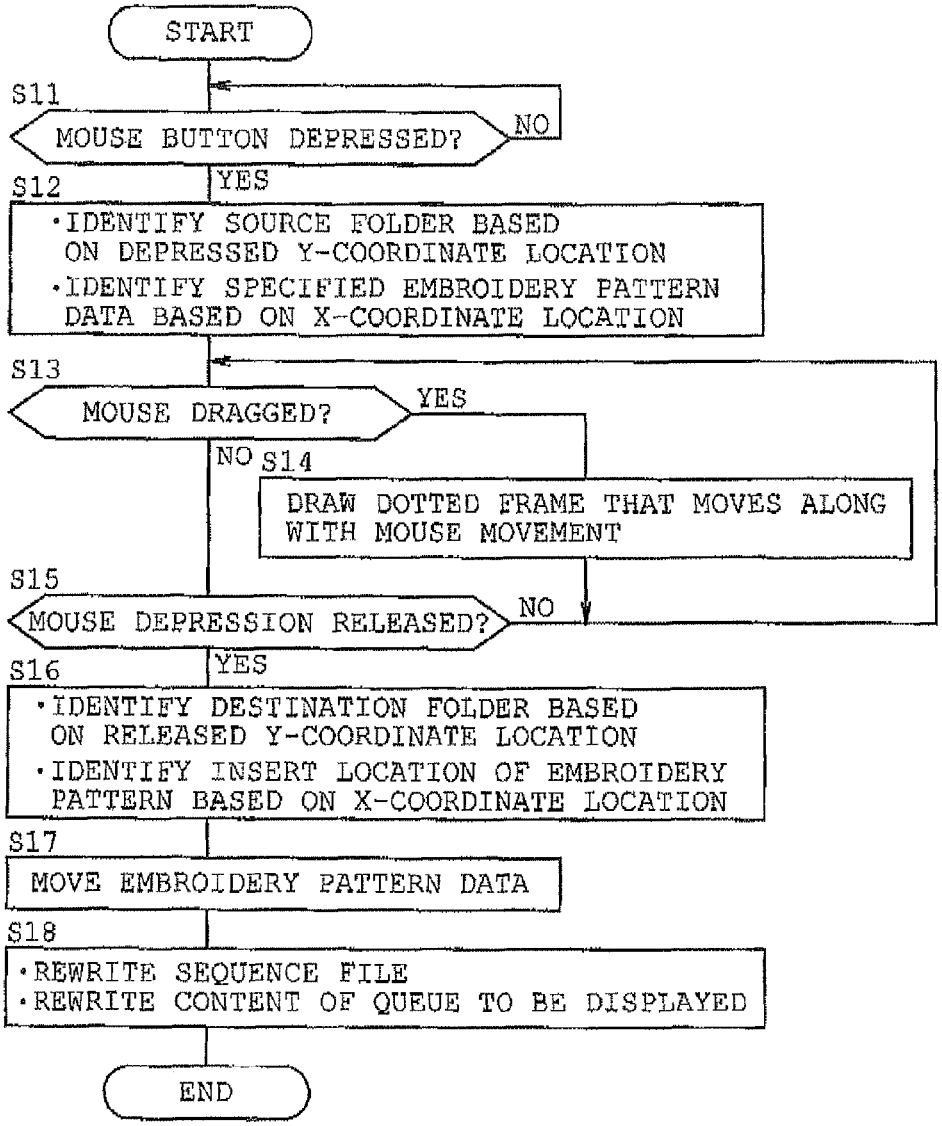
FIG. 6 is a flowchart indicating a process flow of a data rearrangement process.

Referring now to the flowchart of FIG. 6 and the exemplary screen shots of FIGS. 7 to 10, the control flow of data rearrangement process of controller 1 will be described in detail.

Controller 1, after displaying queue Q (M1, M2) on queue display section 202 (M1, M2) of data transfer screen 201 shown in FIG. 4, determines whether or not button 53*a* of mouse 53 has been depressed (step S11). When determining the depression of button 53*a* (step S11: YES), controller 1 proceeds to step S12. At step S12, controller 1 identifies folder F (M1, M2) associated with queue Q (M1, M2) which stores the specified embroidery pattern data, meaning that controller 1 identifies the source folder F (M1, M2) based on the Y-directional location of where mouse 53 was depressed. Based on the X-directional location where mouse 53 was depressed, controller 1 further identifies the specified embroidery pattern data from the embroidery pattern data stored in the source folder F (M1, M2).

Figure 7:
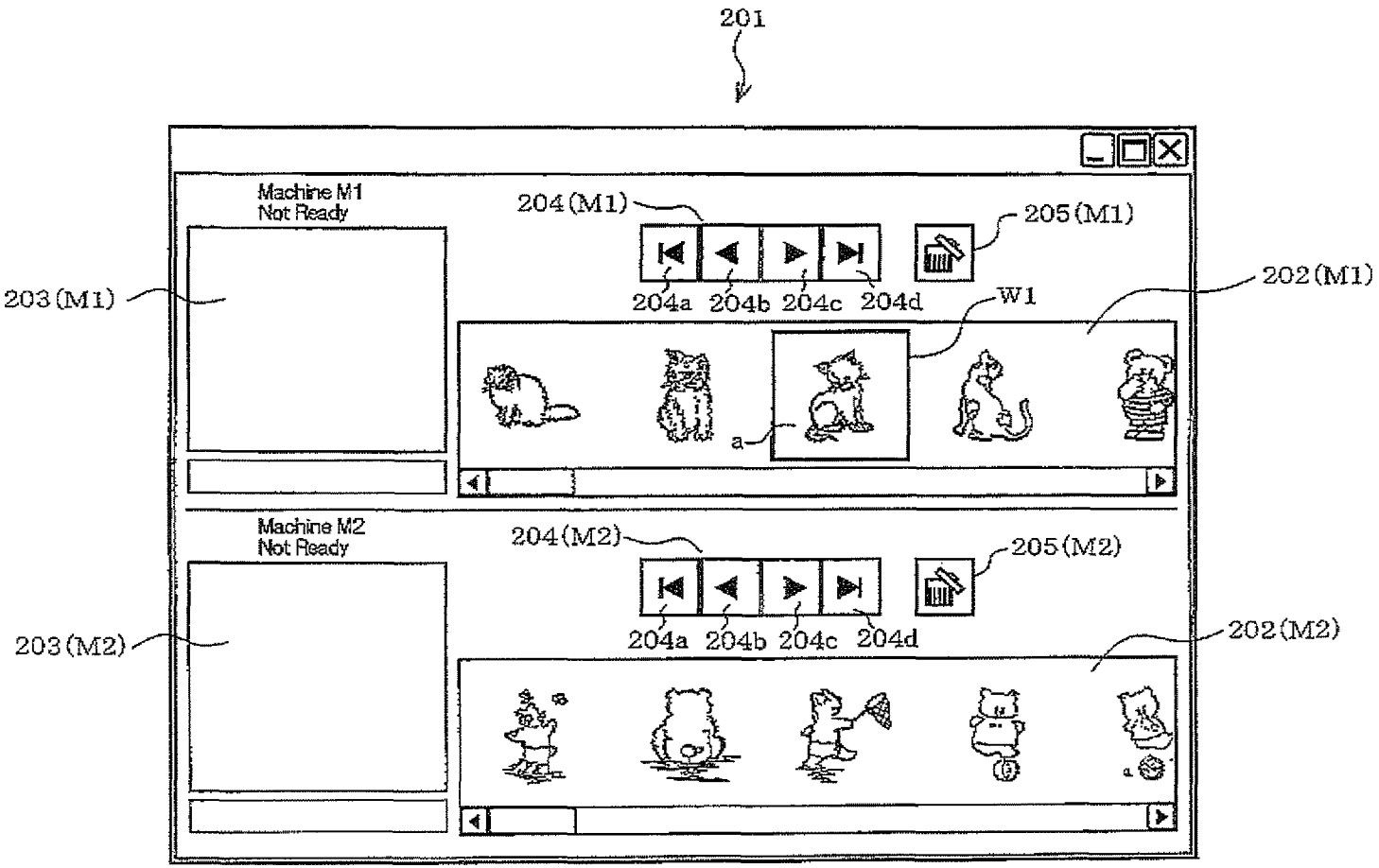
FIGS. 7, 8, 9, and 10 correspond to FIG. 4 and together describe a process flow of a data rearrangement process.

As shown in FIG. 7, controller 1 highlights the specified embroidery pattern data, for instance, with solid line frame W1. In the example shown in FIG. 7, folder F (M1) corresponding to multi-needle sewing machine M1 is specified as the source folder F (M1, M2). Further, embroidery pattern data a is specified from the embroidery pattern data within folder F (M1). FIG. 7 exemplifies a case where a single embroidery pattern data a has been selected; however, more than one embroidery pattern data may be selected alternatively.

Next, controller 1 determines whether or not mouse 53 has been moved with button 53*a* held down (step S13). More specifically, controller 1 determines whether or not mouse 53 has been moved by the presence/absence of change in the location given by X coordinate and Y coordinate from the location where the button 53*a* was depressed and the latest location inputted from mouse 53.

Figure 8:
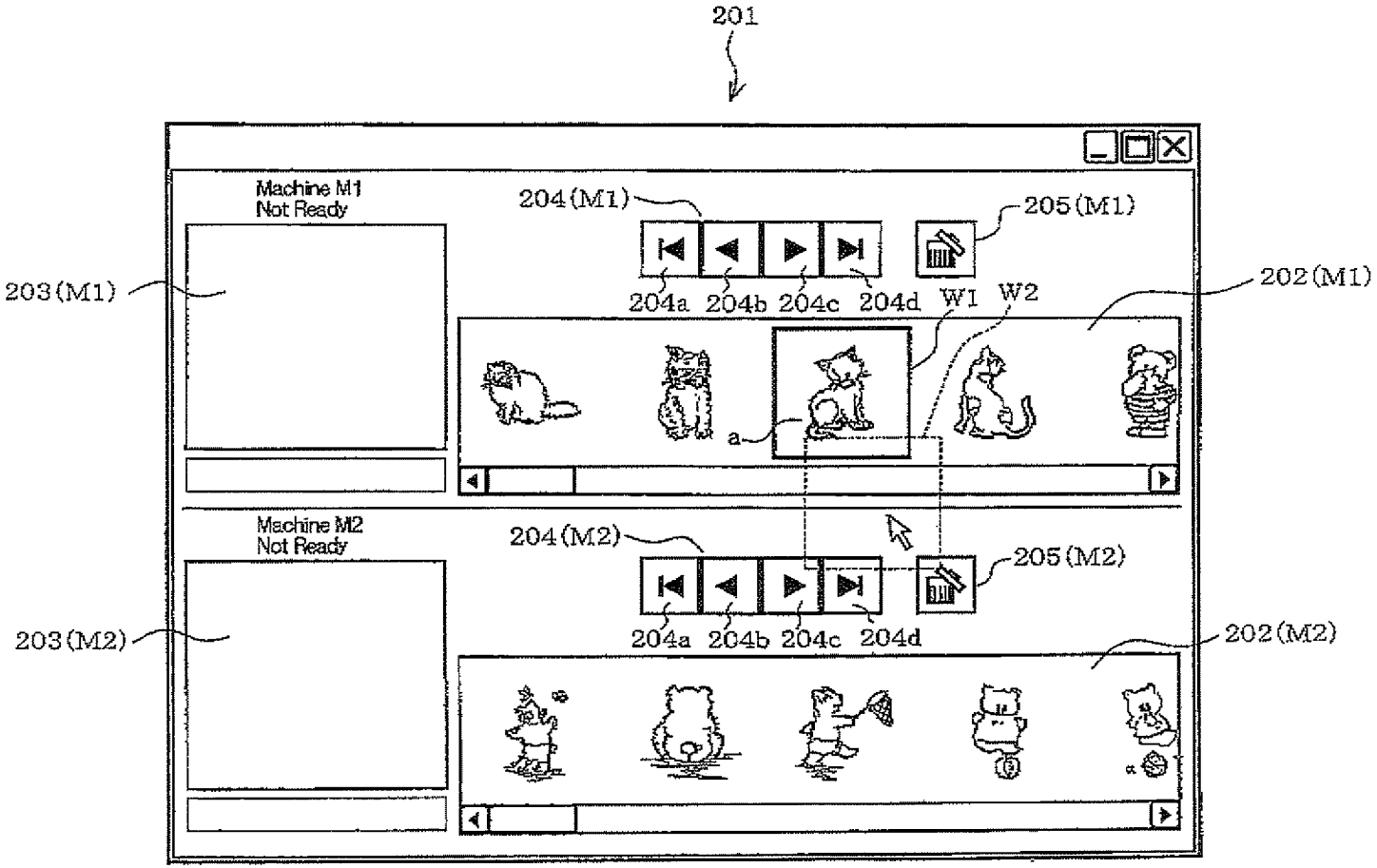

Controller 1, when determining that mouse 53 has been moved (step S13; MS), proceeds to step S14 and displays broken line frame W2 at the destination instead of embroidery pattern data a itself as can be seen in FIG. 8. Broken line frame W2 is an indication that the specified embroidery pattern data a is being moved with the movement of mouse 53. While mouse 53 is in motion (step S13: YES), broken line frame W2 is displayed repeatedly. Thus, broken line frame W2 is moved over data transfer screen 201 with mouse 53 movement.

Controller 1, when determining that mouse 53 has not been moved (step S13: No), further determines whether or not button 53*a* has been released (step S15). Controller 1, when determining that button 53*a* has not been released (step S15: No), proceeds to step S13. By contrast, when controller 1 determines that button 53*a* has been released (step S15: YES), the process proceeds to step S16. At step S16, controller 1 identifies the destination folder F (M1, M2) associated with the destination queue Q (M1, M2) to which the specified folder F (M1, M2) is moved based on the location, given by Y-coordinate, where button 53*a* of mouse 53 was released.

Figure 9:
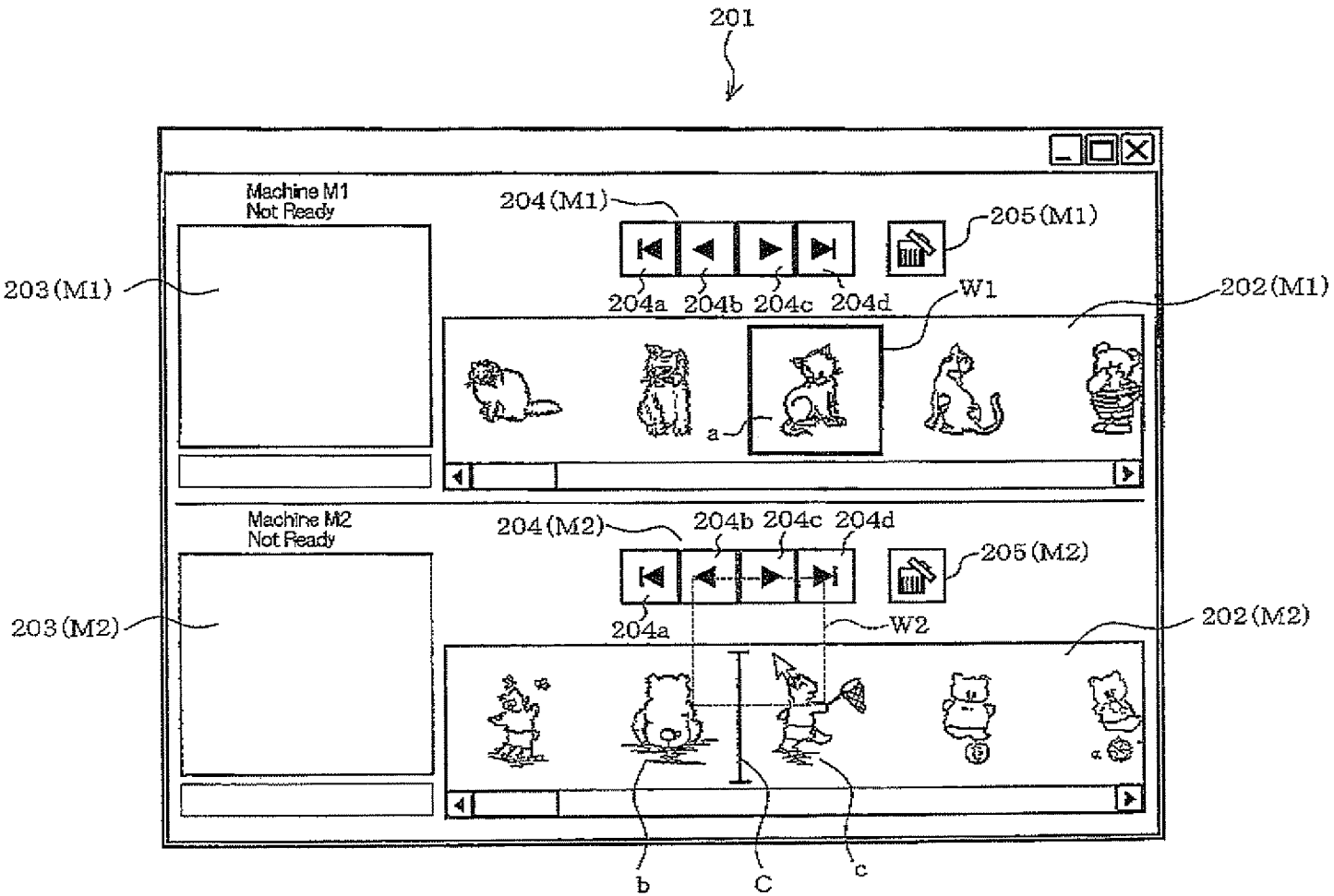
Figure 10:
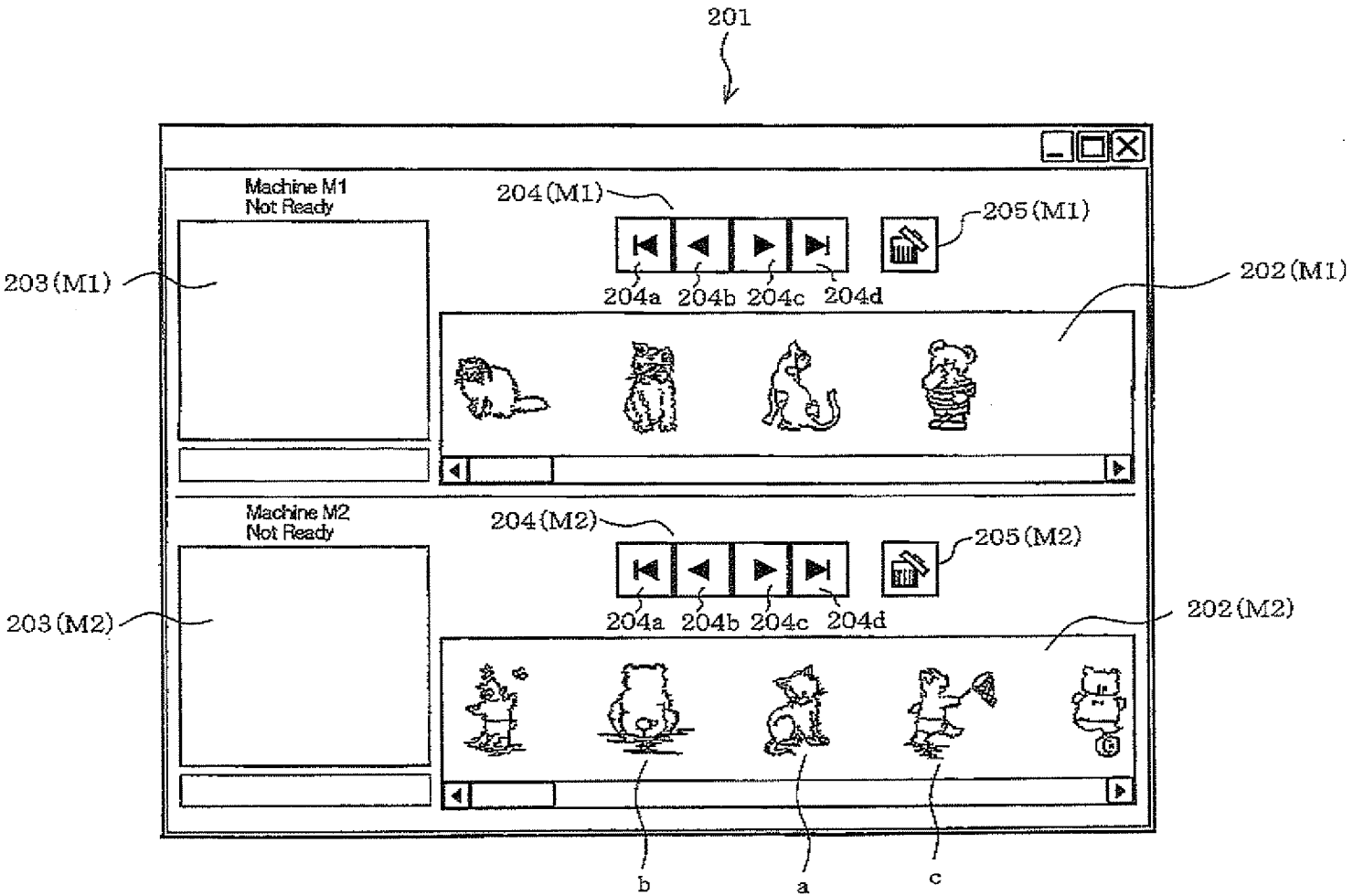

Further, controller 1 determines the location in which specified embroidery pattern data a is to be inserted in the destination queue Q (M1, M2) based on the location, given by X coordinate, where button 53*a* of mouse 53 has been released. As shown in FIG. 9, controller 1 highlights the identified location of insertion by cursor C. At this instance, folder F (M2) associated with multi-needle sewing machine M2 is selected as destination folder F (M1, M2). Within folder F (M2), the location between embroidery pattern data b and embroidery pattern data c as displayed on queue display section 202 is specified as the location of insertion of embroidery pattern data a.

Next, at step S17, controller 1 moves the specified embroidery pattern data a from the source folder F (M1) to the destination folder F (M2). Then, at step S18, controller 1 rewrites the sequence file within folders F (M1) and F (M2) respectively as well as refreshing the display of queue Q (M1) and (M2).

More specifically, controller 1 rewrites the sequence file within folder F (M1) so that the sequence of embroidery pattern data a is deleted and the sequence of other embroidery pattern data coming later in sequence to embroidery pattern a is moved up in sequence. Controller 1 further rewrites the sequence file within folder F (M2) such that embroidery pattern data a is inserted in sequence between embroidery pattern data b and embroidery pattern data c, and embroidery pattern c and embroidery pattern data coming later in sequence to embroidery pattern c are moved down in sequence. Then, controller 1 refreshes content of queues Q (M1) and (M2) displayed on queue display section 202 based on the content of folders F(M1) and (M2) and the sequence files so as to reflect the data transfer. The above described series of steps deletes embroidery pattern data a from queue Q (M1) displayed on queue display section 202 (M1) and inserts embroidery pattern data a in between embroidery pattern data b and embroidery pattern data c of queue Q (M2) displayed on queue display section 202 (M2).

The embroidery pattern data within each of the rearranged queue Q (M1) and (M2) by the above described data rearrangement process is transmitted in the rearranged sequence when multi-needle sewing machine M1, M2 is started, as done for the embroidery pattern data within non-rearranged queue Q (M1, M2).

Instead of deleting the transferred embroidery pattern data from the source folder F (M1, M2) at steps S17 and step S18, controller 1 may be configured to retain the embroidery pattern data within the source folder F (M1, M2) and retain the sequence of the embroidery pattern within the source sequence file to allow copying of the embroidery pattern data as well.

According to the above described first exemplary embodiment, controller 1 displays the embroidery pattern data stored in queue Q (M1, M2) allocated to each of multiple multi-needle sewing machines M1 and M2 on display 52 in a comparative view laid out next to each other. The user is thud, allowed to see the embroidery pattern data stored in each queue Q (M1) and (M2) associated with multi-needle sewing machines M1 and M2 at the same time.

Controller 1 is further configured such that one or more embroidery pattern data within queue Q (M1), for instance, of the specified sewing machine, in this case, multi-needle sewing machine M1, can be transferred to or copied to queue Q (M2), for instance, of the specified sewing machine, in this case, multi-needle sewing machine M2. Controller 1 transmits the embroidery pattern data within each of the rearranged queues (M1) and (M2) by the data rearrangement process to each multi-needle sewing machine M1 and M2. Each multi-needle sewing machine M1 and M2 executes the sewing operation based on the embroidery pattern data within the rearranged queue Q (M1) and (M2). Accordingly, the embroidery pattern data once stored in queue Q (M1) associated with multi-needle sewing machine M1 can be transferred or copied to queue Q (M2) associated with multi-needle sewing machine M2 to be sewn by multi-needle sewing machine M2.

Thus, when the sewing operation needs to be temporary interrupted or stopped due to unforeseen errors or accidents such as needle or bobbin thread breakage encountered at any of the plurality of multi-needle sewing machines M1 and M2 connected to controller 1, the embroidery pattern data within the queue associated with the affected sewing machine can be transferred to the queue of another sewing machine to allow the embroidery patterns to be sewn. Further, in case a queue associated with a given sewing machine contains excessive amount of embroidery pattern data, some of the embroidery pattern data can be transferred to other sewing machines with lightly loaded queues to distribute the load of embroidery sewing among the nodes of embroidery processing system S. Still further, embroidery pattern data once stored in a queue associated with a given sewing machine can be transferred to a queue in another sewing machine that requires less number of thread spool replacement to improve the overall work efficiency of the sewing task carried out by multiple sets of multi-needle sewing machines M1 and M2.

Controller 1 is further provided with mouse 53 that serves as a pointing device. Controller 1 specifies one or more embroidery pattern data stored in queue Q (M1, M2) presented on display 52 that is associated with multi-needle sewing machine M1, M2 in response to the user operation of mouse 53. Controller 1 further transfers or copies the specified one or more embroidery pattern data to queue Q (M1, M2) of other multi-needle sewing machine M1, M2 in response to the user operation of mouse 53. The above described configuration allows the user to readily copy or transfer the embroidery pattern through mouse 53 operation.

The above advantages can be obtained by executing the above described data management software and data transfer data software on controller 1 that is communicably connected to multiple sets of multi-needle sewing machines M1, M2.

A second exemplary embodiment will now be described with reference to FIGS. 11, 12A and 12B. The second exemplary embodiment differs from the first exemplary embodiment in the configuration of the embroidery processing system. According to the second exemplary embodiment, embroidery processing system S' is configured by multi-needle sewing machine M1, M2 that is communicably connected to at least one other sewing machine. The differences from the first exemplary embodiment will be discussed hereinafter.

Figure 11:
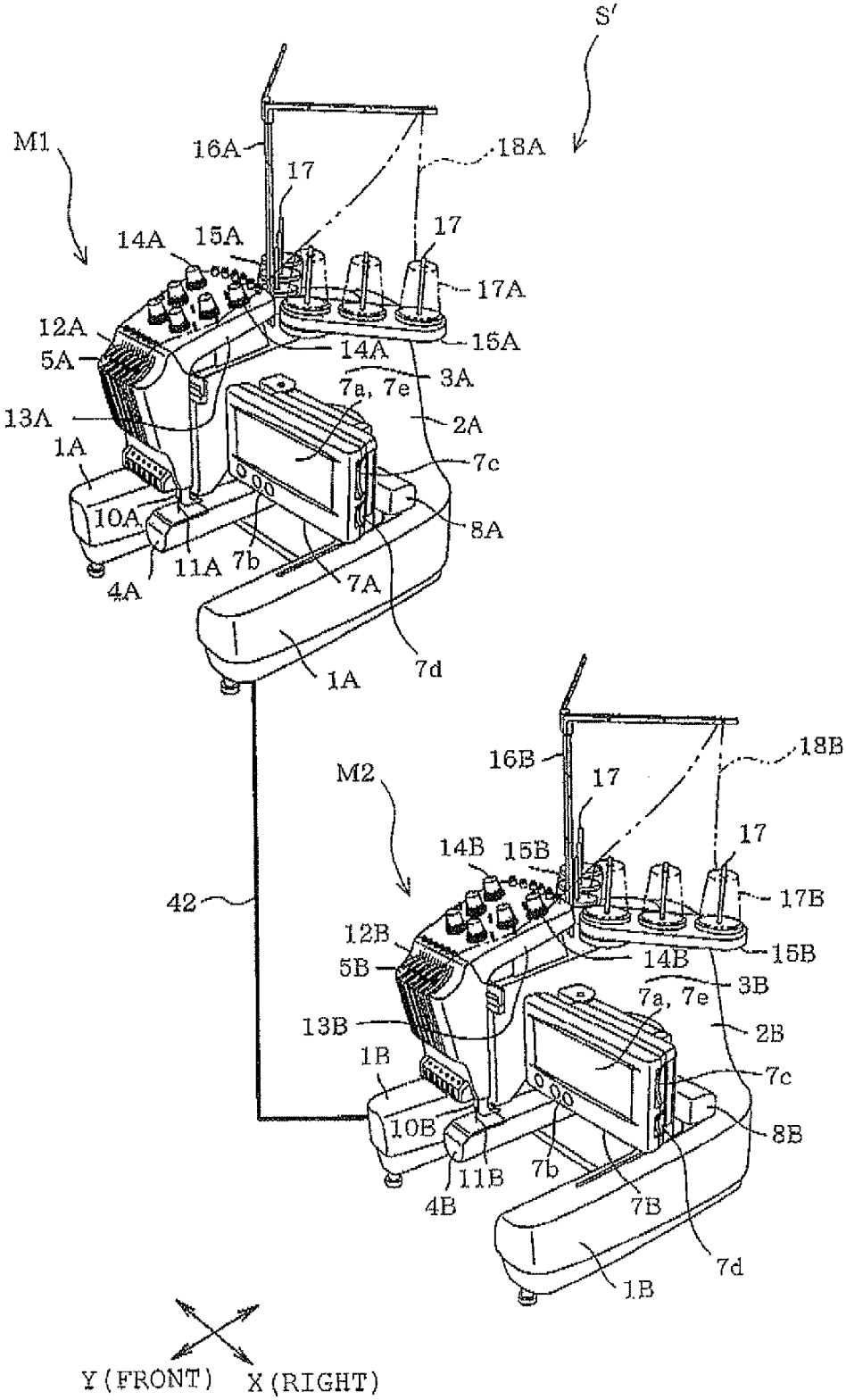
FIG. 11 corresponds to FIG. 1 and illustrates a second exemplary embodiment of the present disclosure.
Figure 12A:
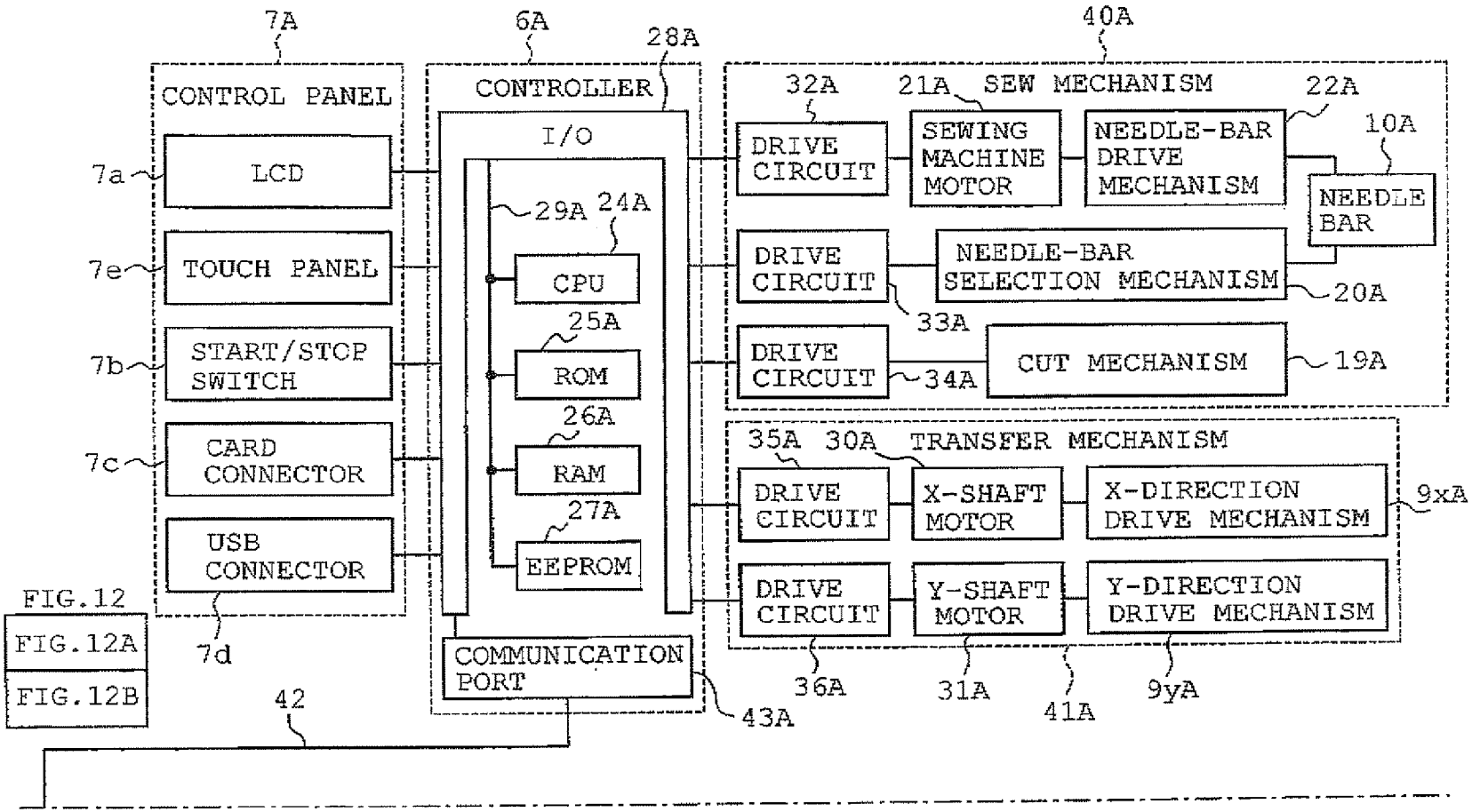
FIGS. 12A and 12B correspond to FIGS. 2A and 2B.
Figure 12B:
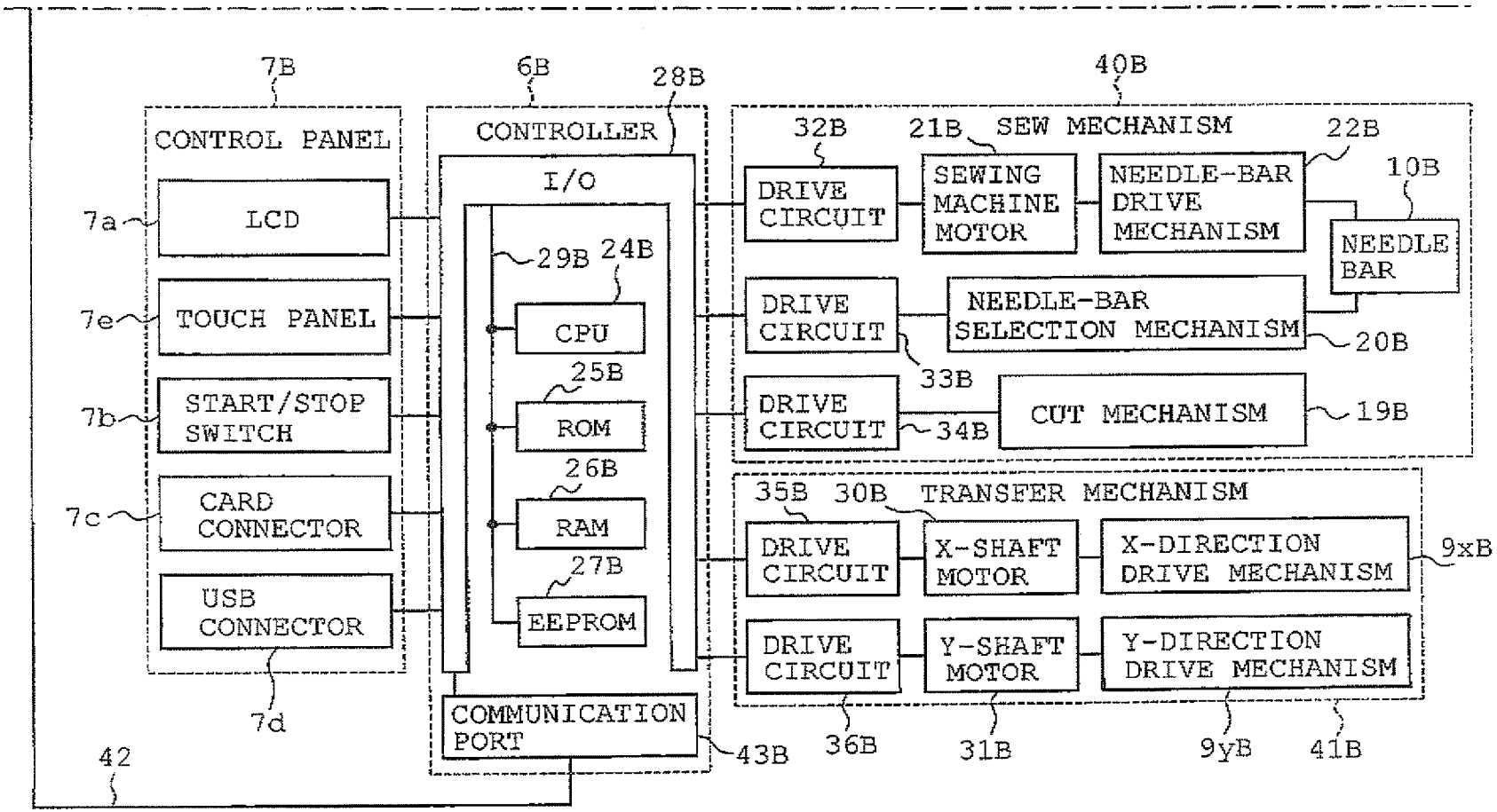

Referring to FIGS. 11, 12A and 12B, multi-needle sewing machines M1 and M2 are communicably connected to each other by communication cable 42 at communication ports 43A and 43B shown in FIGS. 12A and 12B provided at their control units 6A and 6B.

In the second exemplary embodiment, one of the multiple sewing machines, exemplified as a couple of multi-needle sewing machines M1 and M2, serves as controller 1 described in the first exemplary embodiment. Supposing that multi-needle sewing machine M1 serves as controller 1, LCD 7*a* provided at multi-needle sewing machine M1 undertakes the role of display 52. That is, in the second exemplary embodiment, multi-needle sewing machine M1 possesses the capacity of controller 1 described in the first exemplary embodiment in addition to its capability to embroider based on embroidery pattern data.

Thus, control unit 6A of multi-needle sewing machine M1 is configured to execute the sewing machine control program which is configured by a collection of control software such the aforementioned data management software and data transfer software. Control unit 6A is configured to be capable of executing display control process, specification process, data rearrangement process, and data transmission process.

The display control process displays queues Q (M1 and M2) that are each allocated to one of multi-needle sewing machines M1 and M2 including multi-needle sewing machine M1 undertaking controller 1 responsibilities. More specifically, display control process displays the embroidery pattern data stored in queues Q (M1 and M2) on LCD 7*a* such that queue contents are presented in a comparative view such that queue content of multi-needle sewing machines M1 and M2 are laid out next to each other.

The specification process specifies one or more embroidery pattern data from queue Q (M1, M2) displayed on LCD 7*a* allocated to one of multi-needle sewing machines M1, M2.

The data rearrangement process transfers or copies one or more embroidery pattern data specified by the specification process to another queue Q (M2, M1) allocated to another multi-needle sewing machine M2, M1.

Data transmission process transmits the embroidery pattern data within each of the queue Q (M1, M2) modified by the rearrangement process to multi-needle sewing machine M1, M2.

According to the second exemplary embodiment, embroidery pattern data allocated to each of the multiplicity of multi-needle sewing machines M1 and M2 can be displayed simultaneously through LCD 7*a* of multi-needle sewing machine M1 by communicably connecting multi-needle sewing machine M1 with multi-needle sewing machine M2. Further, the allocation of the displayed embroidery pattern data can be rearranged by transferring or copying the embroidery pattern data to other sewing machines to offer the advantages of the first exemplary embodiment of improving the overall work efficiency of sewing operation executed by multiplicity of multi-needle sewing machines M1 and M2.

In a modified exemplary embodiment, multi-needle sewing machine M1 may employ mouse 53 as a pointing device. Under such configuration, control unit 6A may be configured to specify one or more embroidery pattern data from queue Q (M1, M2) associated with one of multi-needle sewing machines M1 and M2 displayed on LCD 7*a* in response to the user operation of mouse 53. Then, controller 6A may transfer or copy the specified one or more embroidery pattern data to queue Q (M1, M2) associated with another sewing machine M1, M2.

The second exemplary embodiment has been discussed by giving the responsibility of controller 1 to multi-needle sewing machine M1, but of course, the task may be given alternatively to multi-needle sewing machine M2.

Next, a third exemplary embodiment will be discussed with reference to FIG. 13. The third exemplary embodiment differs from the first exemplary embodiment in that the embroidery data generated or edited by data generation software can be inputted to queue Q (M1, M2). The difference is further discussed in detail hereinafter.

Figure 13:
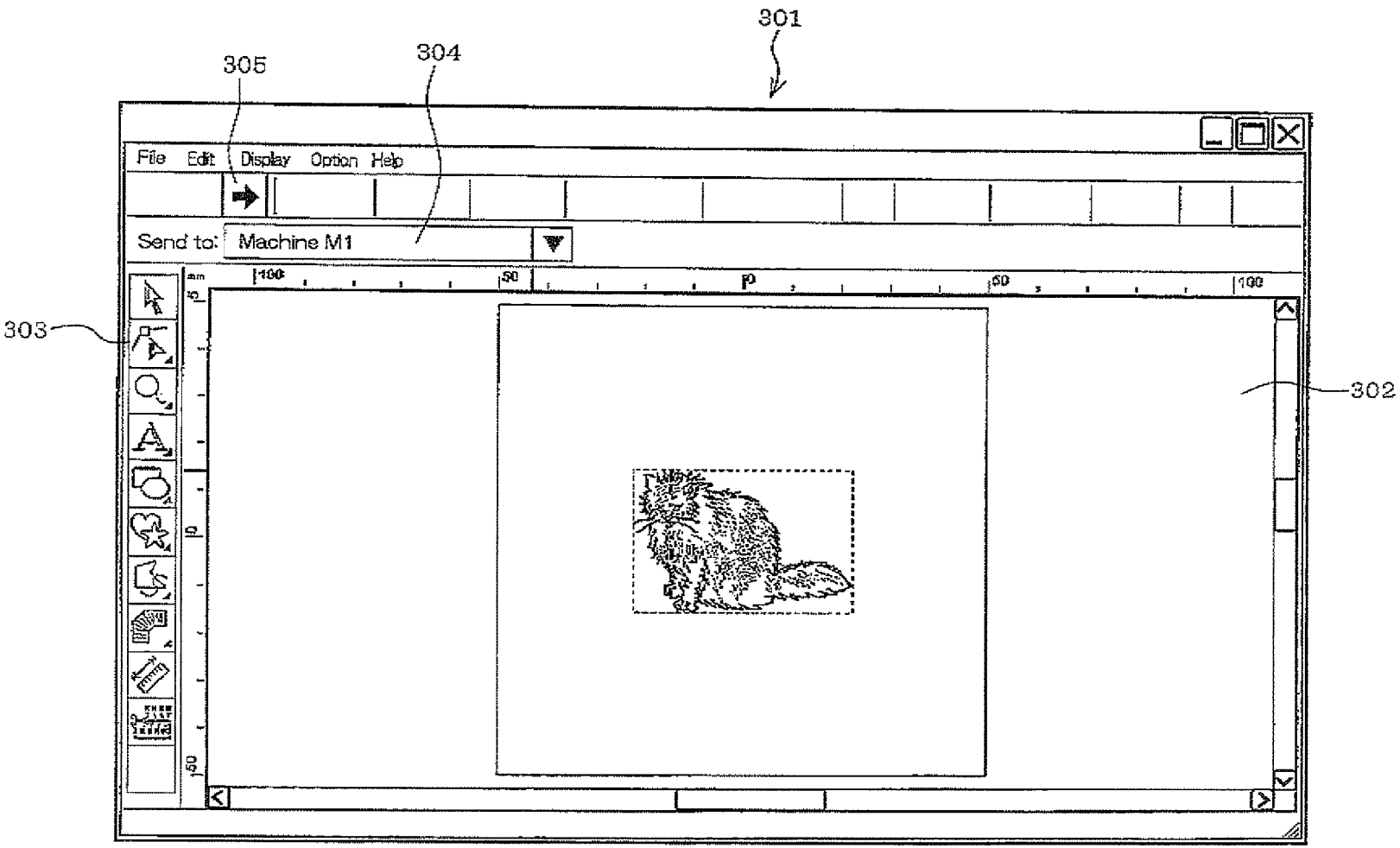
FIG. 13 exemplifies a data generation screen according to a third exemplary embodiment of the present disclosure.

Data generation software outputs data generation screen 301 as exemplified in FIG. 13. Data generation screen 301 contains features such as data display section 302, tool section 303, combo box 304, and input button 305.

Data display section 302 displays generated or edited embroidery pattern data. Tool section 303 provides tool buttons for selecting various tools for generating or editing the embroidery pattern data. The user, through mouse 53, can generate or edit the embroidery pattern data on data display section 302 by using the tools selected from the tool button.

Combo bow 304 is identical in functionality to combo box 103 of the first exemplary embodiment and provides selection of multi-needle sewing machine M1, M2 communicably connected to controller 1 to which embroidery pattern data is to be inputted. The user is to select one of multi-needle sewing machines M1 and M2 through mouse 53 operation.

Input button 305 inputs the generated or edited embroidery pattern data to folder F (M1, M2) and ultimately to queue Q (M1, M2) associated with the multi-needle sewing machine M1, M2 selected at combo box 304.

According to the third exemplary embodiment, user generated embroidery pattern data or edited embroidery pattern data can be inputted into queue Q (M1, M2) corresponding to multi-needle sewing machine M1, M2 in addition to the embroidery pattern data being managed by data management software. Such newly generated or edited embroidery pattern data can also be transferred or copied from queue Q (M1, M2) associated with one of multi-needle sewing machine M1, M2 to queue Q (M2, M1) associated with another multi-needle sewing machine M2, M1 through data transfer software.

Thereafter, the embroidery pattern data may be transmitted to multi-needle sewing machine M1, M2 to be sewn.

The present disclosure is not limited to the above described exemplary embodiments but may be expanded or modified as follows.

The number of sewing machines communicably connected to controller 1 in embroidery processing system S is not limited to 2 but may, for instance, be 3 or more. The number of interconnected sewing machines in embroidery processing system S' is not limited to 2 but may, for instance, be 3 or more.

The communication established between multi-needle sewing machines M1 and M2 and controller 1 in embroidery processing system B and communication established between multi-needle sewing machines M1 and M2 in embroidery processing system S' is not limited to direct communication by way of communication cable 42A, 42B and 42. The communication may also be established indirectly by way of USB hub or other intermediaries. The communication may further be established through wireless LAN (Local Area Network).

The type of sewing machines communicably connected to controller 1 in embroidery processing system S and the type of sewing machines interconnected in embroidery processing system S' is not limited to multi-needle sewing machine. An embroidery sewing machine provided with only a single sewing needle and consequently a single needle bar may be employed instead. Still alternatively, a sewing machine for sewing decorative patterns without an embroidery frame may be employed. In such sewing machine, decorative stitches are formed by a combination of left and right swinging of needle bar and front and rear feeding of the workpiece cloth.

An exchange button may further be provided in the data transfer screen that exchanges the data contained in the queues associated with the multiple sewing machines. Under such configuration, the embroidery pattern data within queue Q (M1, M2) associated with multi-needle sewing machine M1, M2 may be readily exchanged with the embroidery pattern data within queue Q (M2, M1) associated with multi-needle sewing machine M2, M1 by the following operations (a) to (c).

(a): Specify one or more embroidery pattern data displayed on queue display section 202 (M1).

(b) Specify one or more embroidery pattern data displayed on queue display section 202 (M2).

(c): Depress exchange button.

The transferring/copying of the embroidery pattern data is not only done by drag and drop operation of mouse 53 but may also be realized by providing a transfer button or a copy button on data transfer screen 201 and clicking these buttons with mouse 53. The transferring and copying of the embroidery pattern data may also be realized through keyboard 54 operation.

Pointing device may be configured by accessories other than mouse 53 such as a track pad or a track ball.

A touch panel configured by a plurality of touch keys implemented by transparent electrodes may be provided on display 52 such that specification and changing of embroidery pattern data may be done through touch key operation.

Sew pattern data exemplified as embroidery pattern data for sewing embroidery patterns in the foregoing exemplary embodiments may be replaced by other types of data such as decorative pattern data for sewing decorative patterns.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A controller that is communicably connected to a plurality of sewing machines and that includes a display device displaying at least information pertaining to a sewing operation, the controller, comprising:

a display controller that is provided with a plurality of queues, each queue allocated to each of the plurality of sewing machines and that displays, by the display device, sew pattern data stored in each queue of the plurality of queues such that the sew pattern data is organized by the sewing machine of the plurality of sewing machines associated therewith;

a specifier that specifies one or more sew pattern data from a source queue of the plurality of queues associated with one of the plurality of sewing machines displayed on the display device;

a data modifier that transfers or copies the one or more sew pattern data specified by the specifier from the source queue to a destination queue of the plurality of queues associated with another sewing machine of the plurality of sewing machines; and a data transmitter that transmits the sew pattern data modified by the data modifier stored in the source queue and the destination queue to each sewing machines of the plurality of sewing machines associated therewith.

2. The controller according to claim 1, further comprising a pointing device, wherein the specifier specifies the one or more sew pattern data from the source queue in response to a user operation of the pointing device, and the data modifier transfers or copies the one or more sew pattern data specified by the specifier to the destination queue in response to the user operation of the pointing device.

3. The controller according to claim 1, wherein the display controller further displays the sew pattern data having been transferred to the sewing machine in addition to displaying the sew pattern data stored in the queue allocated to the sewing machine.

4. The controller according to claim 3, wherein both the sew pattern data having been transferred to the sewing machine and the sew pattern data stored in the queue allocated to the sewing machine are displayed so as to be organized by the sewing machine associated therewith.

5. The controller according to claim 1, wherein the display controller further displays an exchange button that exchanges the sew pattern data between the plurality of queues in addition to displaying the sew pattern data stored in the queue allocated to the sewing machine.

6. The controller according to claim 5, wherein the exchange button and the sew pattern data stored in the queue allocated to the sewing machine are displayed so as to be organized by the sewing machine associated therewith.

7. The controller according to claim 1, wherein the display controller highlights the sew pattern data specified in the source queue and a location in the destination queue where the specified sew pattern data is to be transferred or copied.

8. The controller according to claim 1, wherein the display controller displays the sew pattern data specified by the specifier as a frame instead of an image of the sew pattern data while the specified sew pattern is being moved.

9. A computer readable medium storing a control program for execution by a controller that is communicably connected to a plurality of sewing machines and that includes a display device displaying at least information pertaining to a sewing operation, the control program, comprising:

instructions for allocating a queue of a plurality of queues to each of the plurality of sewing machines and displaying sew pattern data stored in each queue of the plurality of queues to the display device such that the sew pattern data is organized by a sewing machine of the plurality of sewing machines associated therewith;

instructions for specifying one or more sew pattern data from a source queue of the plurality of queues associated with one of the plurality of sewing machines displayed on the display device;

instructions for modifying to transfer or copy the one or more sew pattern data specified by the specifier from the source queue to a destination queue of the plurality of queues associated with another sewing machine of the plurality of sewing machines; and instructions for transmitting the modified sew pattern data stored in the source queue and the destination queue to the sewing machine of the plurality of sewing machines associated therewith.

10. A sewing machine that is communicably connected to at least one other sewing machine and that includes a display device displaying at least information pertaining to a sewing operation, the sewing machine, comprising:

a display controller that is provided with a plurality of queues, each queue of the plurality of queues allocated to each sewing machines of a plurality of interconnected sewing machines and that displays sew pattern data stored in each queue of the plurality of queues to the display device such that the sew pattern data is organized by the sewing machine of the plurality of interconnected sewing machines associated therewith;

a specifier that specifies one or more sew pattern data from a source queue of the plurality of queues associated with one of the interconnected sewing machines displayed on the display device;

a data modifier that transfers or copies the one or more sew pattern data specified by the specifier from the source queue to a destination queue of the plurality of queues associated with another interconnected sewing machine of the plurality of interconnected sewing machines; and a data transmitter that transmits the sew pattern data modified by the data modifier stored in the source queue and the destination queue to each of the sewing machines of the plurality of interconnected sewing machines associated therewith.

11. The sewing machine according to claim 10, further comprising a pointing device, wherein the specifier specifies the one or more sew pattern data from the source queue in response to a user operation of the pointing device, and the data modifier transfers or copies the one or more sew pattern data specified by the specifier to the destination queue in response to the user operation of the pointing device.

* * * * *